US010927629B2

(12) United States Patent
Zhang

(10) Patent No.: US 10,927,629 B2
(45) Date of Patent: Feb. 23, 2021

(54) DOWNHOLE MACHINING TOOL

(71) Applicant: Halliburton Energy Services, Inc., Houston, TX (US)

(72) Inventor: Lizheng Zhang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 4 days.

(21) Appl. No.: 16/333,706

(22) PCT Filed: Dec. 27, 2016

(86) PCT No.: PCT/US2016/068733
§ 371 (c)(1),
(2) Date: Mar. 15, 2019

(87) PCT Pub. No.: WO2018/125054
PCT Pub. Date: Jul. 5, 2018

(65) Prior Publication Data

US 2019/0218875 A1 Jul. 18, 2019

(51) Int. Cl.
*E21B 29/00* (2006.01)
*E21B 4/18* (2006.01)
*E21B 10/26* (2006.01)

(52) U.S. Cl.
CPC ..... *E21B 29/002* (2013.01); *E21B 4/18* (2013.01); *E21B 10/26* (2013.01)

(58) Field of Classification Search
CPC ..... E21B 29/00; E21B 29/002; E21B 10/26; E21B 4/18
See application file for complete search history.

(56) References Cited

U.S. PATENT DOCUMENTS

| | | | | |
|---|---|---|---|---|
| 5,168,944 | A | 12/1992 | Andersson | |
| 6,702,040 | B1 | 3/2004 | Sensenig | |
| 7,757,784 | B2 * | 7/2010 | Fincher | E21B 7/20 166/242.7 |
| 8,220,541 | B2 | 7/2012 | Martinez et al. | |
| 8,388,280 | B1 | 3/2013 | Ison | |
| 8,622,666 | B2 | 1/2014 | Kozak | |

(Continued)

FOREIGN PATENT DOCUMENTS

| | | | |
|---|---|---|---|
| CN | 104117881 | A1 | 10/2014 |
| WO | 2014-038952 | A1 | 10/2014 |

OTHER PUBLICATIONS

International Search Report and Written Opinion dated Sep. 21, 2017 for PCT Application No. PCT/US2016/068733 filed Dec. 27, 2016.

(Continued)

*Primary Examiner* — Catherine Loikith
(74) *Attorney, Agent, or Firm* — Chamberlain Hrdlicka

(57) ABSTRACT

A rotary tool for machining a material in a downhole environment. The rotary tool includes a drive train and a lead screw connected to and rotatable by the drive train The tool also includes a linear block engaged with but not rotatable by the lead screw so as to convert the rotation of the lead screw into linear motion The tool also includes a machining tool rotatable by the lead screw and movable linearly by the linear block to machine the material. Also, the machining tool machines the material in a series of steps.

20 Claims, 6 Drawing Sheets

(56) References Cited

U.S. PATENT DOCUMENTS

| | | | | |
|---|---|---|---|---|
| 2004/0124010 | A1* | 7/2004 | Galloway | E21B 17/07 175/57 |
| 2012/0029702 | A1 | 2/2012 | Tverlid | |
| 2012/0168176 | A1 | 7/2012 | Aguirre et al. | |
| 2014/0138083 | A1 | 5/2014 | Fanini et al. | |
| 2014/0305653 | A1 | 10/2014 | Lee et al. | |
| 2014/0369776 | A1 | 12/2014 | Durfee | |

OTHER PUBLICATIONS

Rattray, Frank, et al., "Milling of Cast-Iron Bridge Plug With Electric-Line-Conveyed Technology," SPE International (SPE 113288), Apr. 1-2, 2008, pp. 1-6, The Woodlands, Texas.

Schwanitz, B.J., "Nipple Profile Milling with Electric Wireline Interventions", SPE International (SPE 130708), Mar. 23-24, 2010, pp. 1-8, The Woodlands, Texas.

* cited by examiner

DOWNHOLE MACHINING TOOL

BACKGROUND

This section is intended to provide relevant contextual information to facilitate a better understanding of the various aspects of the described embodiments. Accordingly, it should be understood that these statements are to be read in this light and not as admissions of prior art.

During machining operations, e.g., drilling, milling, etc., in an oilfield environment, rotary assemblies are commonly used to form openings in a formation and/or machine a workpiece or an obstruction located in a wellbore. A rotary assembly can include a rotary module that provides rotational motion. The rotational output can drive a bit to grind, cut, scrape, and crush the workpiece, and/or the obstruction. A tractor module, or other actuation device, can be used to advance the rotary assembly further into the wellbore and to provide a force to the bit. In this regard, the tractor module provides the linear translation power to provide a feed rate, i.e., rate of penetration ("ROP") to linearly move the bit while the rotary module provides power to rotate the bit i.e., rotations per minute ("RPM").

BRIEF DESCRIPTION OF THE DRAWINGS

For a detailed description of the embodiments of the invention, reference will now be made to the accompanying drawings in which.

DETAILED DESCRIPTION

Figure 1:
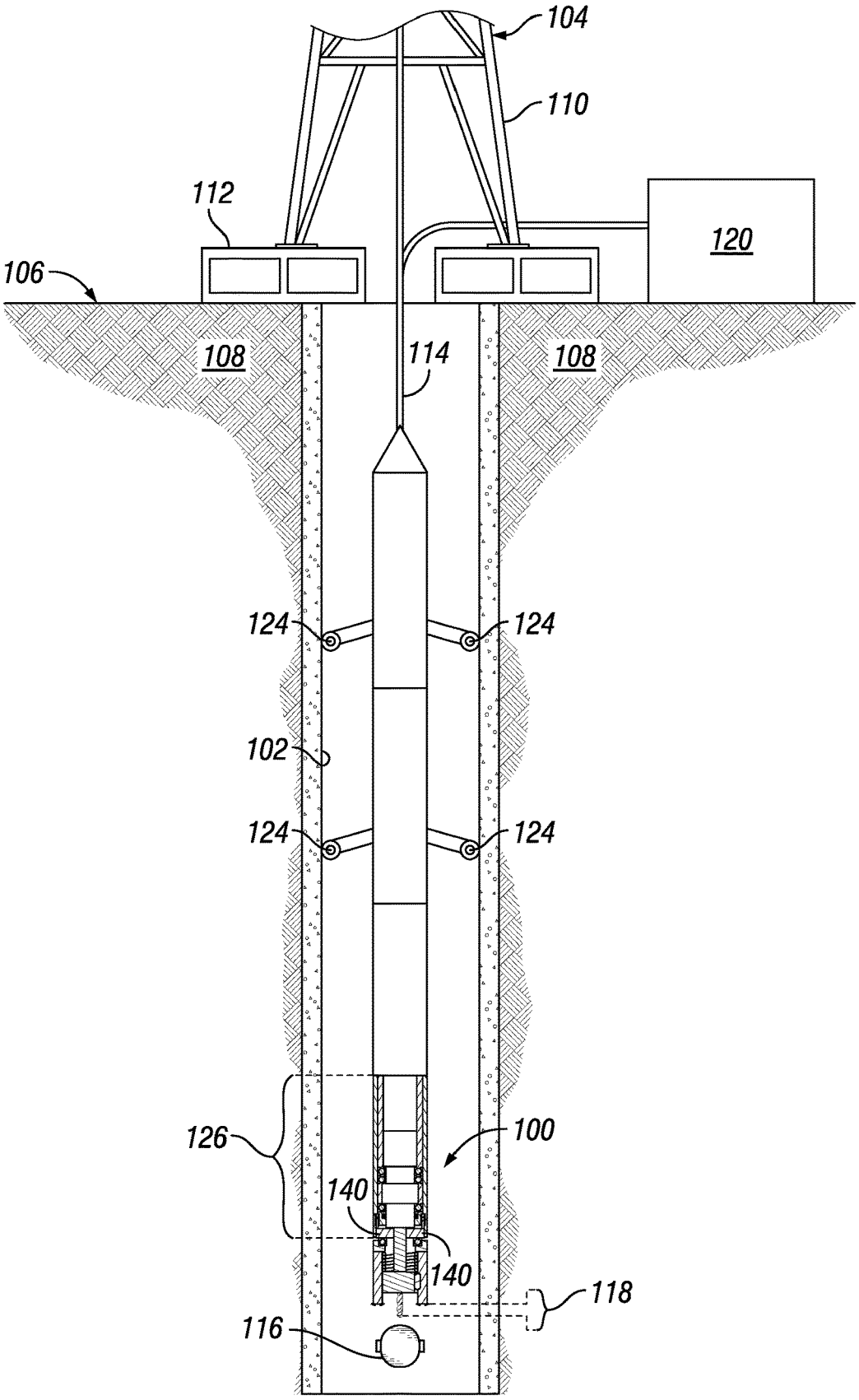
FIG. 1 depicts a perspective view of an example rotary downhole tool located in a wellbore, according to one or more embodiments.

Referring to FIG. 1, a perspective view of a rotary downhole tool 100 located in a wellbore 102 in accordance with one or more embodiments is illustrated. A rig 104 is positioned on a surface 106 and extends over and around the wellbore 102. The wellbore 102, as shown, is near-vertical, but can be formed through a subterranean formation 108 at any suitable angle. The wellbore 102 penetrates the formation 108 to carry out exploration and extraction of hydrocarbons from the formation 108, where various other operations, including well intervention operations, can occur. Well intervention, as described herein, includes carrying out operations during and after the completion of a well, for example, stimulation of a targeted area or removal of objects from the wellbore 102.

The rig 104 includes a derrick 110 with a rig floor 112 through which a cable 114 (e.g., wireline, jointed pipe, or coiled tubing) extends downwardly from the rig 104 to suspend the rotary downhole tool 100 in the wellbore 102. The rotary downhole tool 100 performs operations to machine an object, such as a workpiece 116, located in the wellbore 102. As described herein, machining includes milling, honing, brushing, drilling, among processes or otherwise creating holes, openings, cuts, and slots, to cut or remove the workpiece 116. The workpiece 116 includes tools and devices (e.g., bridge plugs, cement plugs, valves) located in the wellbore 102 and can be made of metal, metal alloys, fiberglass, durable plastics, and the like. The workpiece 116 also refers to scale, paraffin, sand, or other surfaces and obstructions formed on a surface of the wellbore 102 or other surfaces located within the wellbore 102. The workpiece 116 and/or obstructions may potentially limit hydrocarbon production or interrupt completion operations, for example, during the placement of completion assemblies in the wellbore 102. The dimensions of the workpiece 116 may range from about 1 inch (in) (2.54 centimeters (cm)) to about 48 in (4 feet (ft)). In operations, the rotary downhole tool 100 mounts and rotates a machining tool 118 (e.g., bit, cutter) that directly contacts and cuts the workpiece 116. As shown in FIG. 1, the rotary downhole tool 100 is electrically coupled to a surface system 120 that includes, for example, a recording unit, a communications unit, and/or a measurement unit.

A tractor 122 is be deployed in the wellbore 102 using the cable 114 and used to maneuver the rotary downhole tool 100 and other well intervention downhole tools to a desired location in the wellbore 102. The tractor 122 anchors to an inner surface wall of the wellbore 102 using anchors 124 to stabilize and to provide anti-rotational torque and anti-slipping force to the rotary downhole tool 100. The location of the rotary downhole tool 100 can be determined using, for example, a casing collar locator or any other means to determine and verify the location of the tool 100.

The tractor 122 may also provide linear output to translate the rotary downhole tool 100 in a linear direction and additionally provide a feed rate, i.e., rate of penetration ("ROP"), to the machining tool 118. The speed of the feed rate may vary based on several factors such as material hardness, desired cutting diameter, among others. For instance, the tractor 122 may provide a high feed rate, about 0.10 inches/minute (in/min), during light-duty and long-distance machining operations. However, higher feed rates provide less control of the machining tool 118, leading to less than precise machining. Conversely, it is often difficult for the tractor 122 to provide a lower, more accurate feed rate (about 0.005 in/min) to the machining tool 118 for various workpieces, for example, certain alloys used in completion downhole tools or medium to hard rocks. If the feed rate is high, the torque output may increase and the machining tool 118 may stall or break prematurely. If the feed rate is low, work hardening of the workpiece 116 may occur.

The rotary downhole tool 100 includes a rotary drive train 126 that produces rotational output, i.e., rotational motion and rotational force (i.e., torque output), to rotate the machining tool 118 and a linear block 140 engaged with but not rotated by the machining tool 118. To provide the linear motion, as opposed to using the tractor 122, the linear block 140 receives and converts the rotational output from the drive train 126 into linear motion. In the embodiments, the linear motion from the linear block 140 is used to linearly translate the machining tool 118 in either a forward direction or a reverse direction. Accordingly, the rotary downhole tool 100 provides both rotational output to provide a cutting speed (i.e., rotations per minute "RPM") via the drive train 126 and linear translation to provide a feed rate, (i.e., ROP), thus, advancing the machining tool 118 into the workpiece 116 via the linear block 140. By using a rotary downhole tool 100 that produces both rotational and linear outputs, the ROP and the RPM of the machining tool 118 can be proportionally controlled during machining operations. In particular, the rotary downhole tool 100 of the embodiments generates a proportional RPM to ROP ratio that extends and/or optimizes the life of the machining tool 118, for instance, by maintaining even wear of the tool 118 at a controlled rate. In this case, the machining tool 118 can be used for both high feed rate (e.g., light-duty and long-distance machining applications) and low feed rate applications (e.g., high-duty and short-distance machining applications). If the RPM to ROP ratio is too low, excessive wear of the machining tool 118 can occur. If the RPM to ROP ratio is too high, the machining tool 118 may polish instead of machining a surface.

While the rotary downhole tool 100 has been shown and described with respect to certain preferred embodiments, it is obvious that equivalent alterations and modifications will occur to others upon the reading and understanding of the specification. For example, other components that may be present in the embodiments include, but are not limited to, other well completion equipment and devices, pumps, controllers, sensors, and the like.

Figure 2:
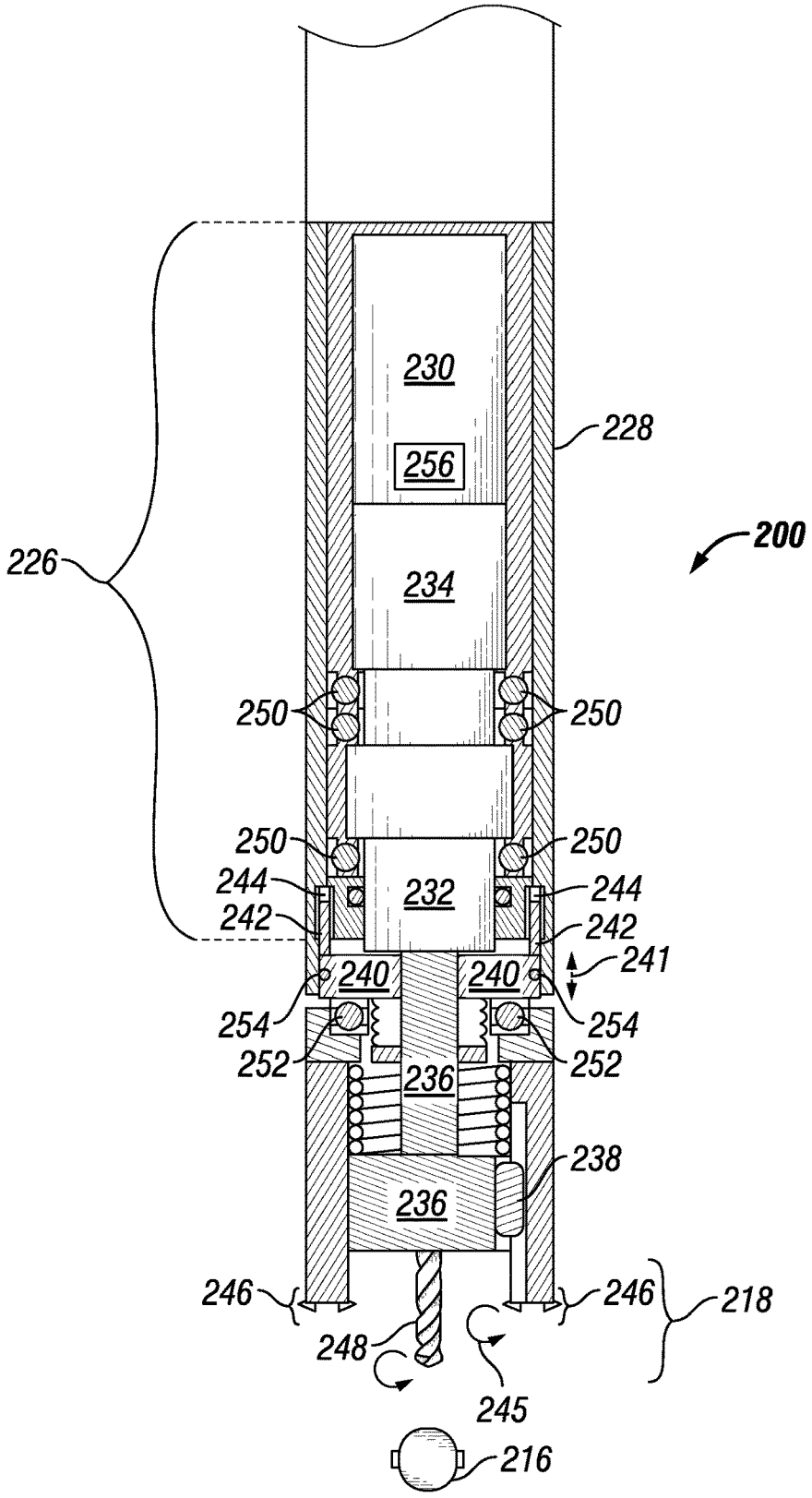
FIG. 2 depicts a detailed cross-sectional view of an example rotary downhole tool including a rotary machining tool, according to one or more embodiments.

FIG. 2 illustrates a detailed cross-sectional view of a rotary downhole tool 200 including a rotary machining tool 218, in accordance with one or more embodiments. The rotary downhole tool 200 includes a housing 228 to house a rotary drive train 226 that includes a motor 230, a drive shaft 232, and a gearbox 234 that are mechanically coupled with each other. The gearbox 234 can alter the rotational speed and the torque output of the rotary drive train 226 based on desired conditions, for instance, by increasing the rotational speed while decreasing the torque output or decreasing the rotational speed while increasing the torque output. In some examples, a field joint may be located between other electronic components of the rotary downhole tool 200 and the rotary drive train 226 such that the gearbox 234 is configured at field locations.

The motor 230 produces the rotational force and torque output, i.e., rotational output, that is transmitted to the gear box 234 to rotate the drive shaft 232. A lead screw 236 is operatively connected to the drive shaft 232 and thus, receives the rotational output. The lead screw 236 may be built into or mounted into the drive shaft 232 as a separate component via a coupling mechanism. In some examples, the lead screw 236 may be protected by a bellow or other protective means to prevent contamination. As the drive shaft 232 rotates, the lead screw 236 rotates with the drive shaft 232.

The machining tool 218 may be received by or permanently affixed to the lead screw 236. In the examples, the machining tool 218 is engaged with the lead screw 236 using a keyed connection 238. The keyed connection 238 rotates with the lead screw 236 so that the machining tool 218 correspondingly rotates with the lead screw 236 in either a forward direction into a workpiece 216 or reverse direction away from the workpiece 216. Specifically, the motor 230 that is operatively connected to the lead screw 236 via the drive shaft 232 outputs either forward or reverse rotational output.

A linear block 240 is engaged and keyed to the housing 228 using a dowel pin 242 that is configured to align and fit within a mating channel 244 formed in the housing 228. The linear block 240 can engage with the lead screw 236 (e.g., a ball screw) via a nut 243 (e.g., a ball nut), or other engaging component, located internally within the linear box 240. Although the lead screw 236 rotates, the linear block 240 does not rotate due to the dowel pin 242 connection with the housing 228. The linear block 240 converts the generated rotational output into linear motion to axially translate the machining tool 218 into contact with the workpiece 216. In particular, the rotary motion of the lead screw 236 is transformed to linearly translate the nut 243. The nut 243 located in the linear block 240 is engaged with threads of the lead screw 236, thus, the nut in the linear block 240 does not rotate with the lead screw 236 but translates along the axis of the lead screw 236 as the lead screw 236 rotates. The direct contact with the lead screw 236 linearly moves the nut 243, and thus the linear block 240, along a longitudinal axis of the lead screw 236. For example, the linear block 240 moves in a forward or reverse direction (as shown by the arrow 241) to exert a linear force on the machining tool 218 depending on the direction of rotation of the lead screw 236. Accordingly, the rotary drive train 226 drives the movement of the machining tool 218 by supplying rotational motion via the lead screw 236. The linear block 240 engaged with the lead screw 236 converts the rotational output of the lead screw 236 into the linear output to axially translate the machining tool 218 towards or away from the workpiece 216.

The pitch of the lead screw 236 is the distance between the center of two lead screw threads and can be used to determine a proportional ratio between the RPM and ROP. The proportional RPM to ROP ratio provides the machining tool 218 both optimal rotation and linearly translation of the rotary downhole tool 200 at varied feed rates and feeds speeds. The pitch of the lead screw 236 may be minimal to accommodate slow feed rates, e.g., about 0.005 in/min to about 0.5 in/min, that are proportional to feed speeds of the machining tool 218. Conversely, the pitch of the lead screw 236 may be increased to accommodate higher feed rates, e.g., about 0.5 in/min and above, that are proportional to feed speeds of the machining tool 218.

The machining tool 218 may include one or more fixed bits or other types of bits and cutters, for example, a cutter 246 that rotates, as shown by arrow 245 since the key connection 238 engages with the cutter 246. In one or more embodiments, the cutter 246 includes one or more cutting bits or blades, for example, an inner cutter and an outer cutter, among others. The cutter 246 cuts an annulus area in the workpiece 216 so as to remove a circular section(s) with a diameter range of about 3 inches (in) to about 12.5 in (75-320 millimeters (mm)) and hole depth range from about 12 in (300 mm) up to about 48 in (4 feet (ft)). For example, the cutter 246 may include a hole-saw, a trepanning bit, or a coring bit.

In addition to the cutter 246, the machining tool 218 can include a center cutter 248 to machine a cylindrical hole or a round hole in the workpiece 216. The center cutter 248 is mounted to the lead screw 236 so as to correspondingly rotate with the lead screw 236. The center cutter 248 is attached to the lead screw 236 by either a keyed connection or clamps. In other examples, the center cutter 248 may be engaged with the cutter 246 so as to rotate and linearly move with the cutter 246. The center cutter 248 further provides stability to the cutter 246 by reducing or preventing wobbling or a lack of proper balance. In some cases, the center cutter 248 may be a step drill or another type of bit designed to minimize cutting torque and may include a core-catching spring or other device to catch the cuttings of the cutter 246.

Both the cutter 246 and the center cutter 248 can machine from about 0.1 in (2.54 mm) to about 3 in (76 mm) into workpiece 216 in a single machining operation. The machining tool 218 can be replaced such that different bits and/or cutters of varied pitches can be used to carry out various machining operations at different feed speeds and feed rates. In this regard, various types of materials, such as cast iron and rocks with varied hardness, can be machined. The machining tool 218 may further include a replaceable stabilizer to prevent vibrational and accidental damage to a casing of a wellbore.

The reaction of the machining tool 218 on the workpiece 216 may cause the rotary downhole tool 200 and its components to vibrate. To suppress vibrations and other unnecessary motion, the rotary drive train 226 further includes radial bearings 250 and thrust bearings 252. The radial bearings 250 and the thrust bearings 252 support the various loads on the rotary downhole tool 200 and transmit the feed speed, i.e., ROP, and the torque output from the drive shaft 232 to the machining tool 218. The rotary downhole tool 200 can also include rotary seals 254 to retain the lubricant for the radial bearings 250 and the thrust bearings 252, and thus enhancing the performance and life of the bearings 250, 252. The rotary seals 254 may further minimize dirt, oil, water, and other influences that may cause damage and/or premature failure of the bearings 250, 252 and other components of the tool 200.

While the rotary downhole tool 200 has been shown and described with respect to certain preferred embodiments, it is obvious that equivalent alterations and modifications will occur to others upon the reading and understanding of the specification. Other components that may be present in the embodiments include, but are not limited to, other well completion equipment and devices, pumps, controllers, sensors, and the like. For example, the rotary downhole tool 200 may include a turbine 256 connected, wired or wirelessly, to the machining tool 218 that provides circulation for cutting displacement and cooling. Additionally, the rotary downhole tool 200 may include a cleaning component to clean debris deposited on or near the workpiece 216.

Figure 3A:
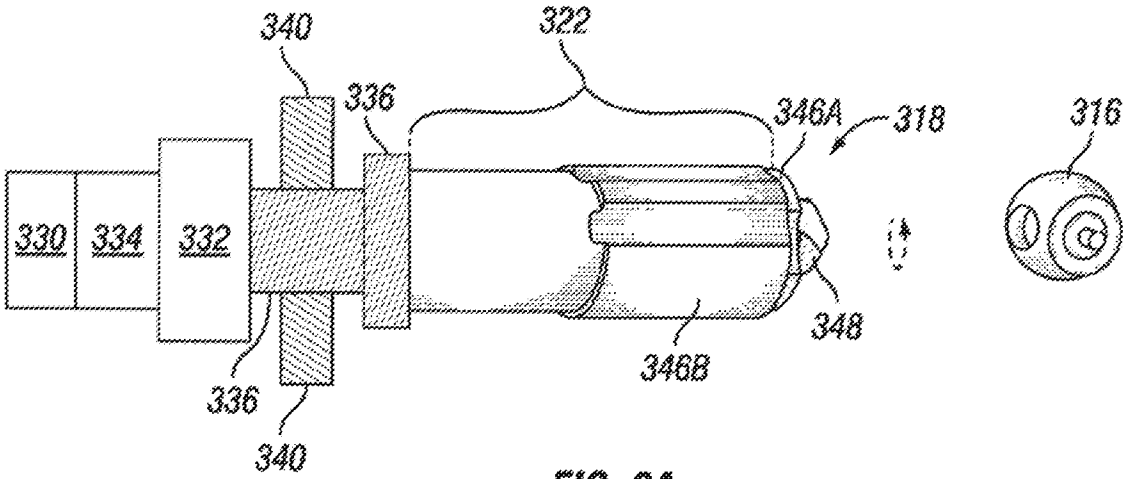
FIG. 3A depicts a perspective view of an example telescopic machining tool in a retracted position, according to one or more embodiments.

FIG. 3A is a perspective view of a telescopic machining tool 318 in a retracted position 322. The tool 318 retracts to form a telescoping configuration that includes an inner cutter 346A slidably nested within an outer cutter 346B and a center cutter 348 slidably nested within the inner cutter 346A. A motor 330 of the machining tool 318 is operatively connected to provide rotational force and rotational output via a drive shaft 332. A gearbox 334 may alter the rotational speed and the torque output of the motor 330. The motor 330 may output rotational motion, linear motion, or both, for example, as described with respect to the motor 230 of FIG. 2. A lead screw 336 is operatively connected to the drive shaft 332 and thus, rotates as the drive shaft 332 rotates. A linear block 340 engaged with the lead screw 336 converts the rotational output from the lead screw 336 into the linear output to axially translate the machining tool 318 towards or away from a machineable object, for example, a workpiece 316. The machining tool 318 is axially translated in a reverse direction and into the retracted position 322 to move away from so as to not cut into the workpiece 316. As will be described with respect to FIG. 3B, the machining tool 318 is axially translated in a forward direction to press against the workpiece 316 and rotates at a rotational speed to cut into the workpiece 316.

Figure 3B:
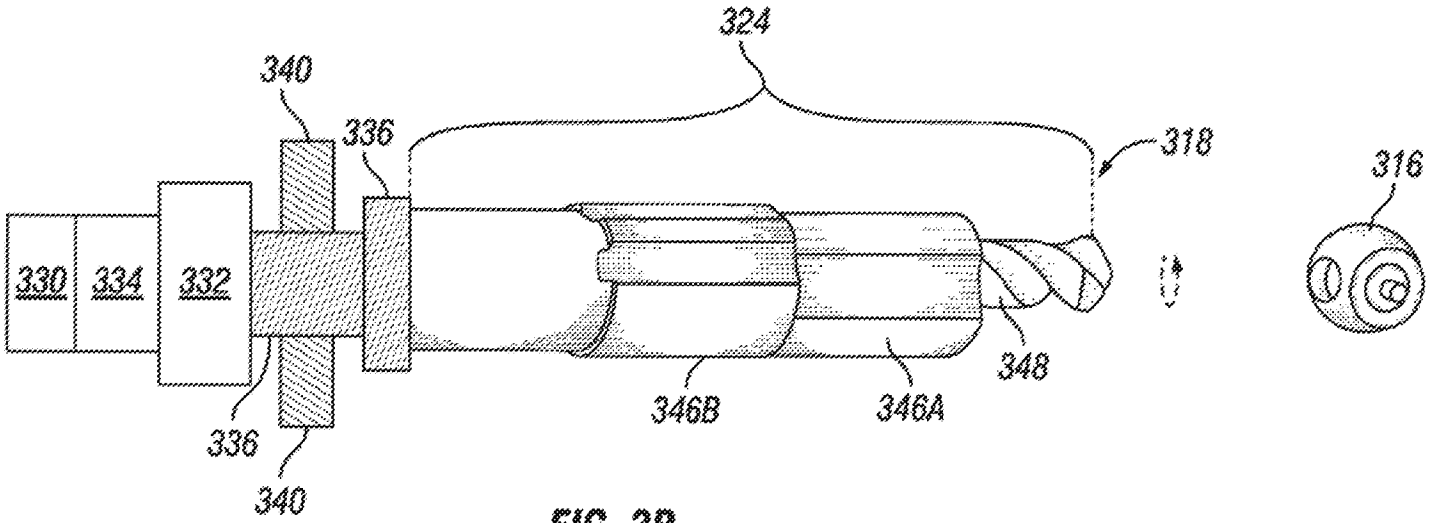
FIG. 3B depicts a perspective view of the example telescopic machining tool of FIG. 3A in an extended position, according to one or more embodiments.

FIG. 3B is a perspective view of the telescopic machining tool 318 in an extended position 324. As shown, the tool 318 includes an outer cutter 346B, an inner cutter 346A, and a center cutter 348 with the outer cutter 346B being the outer-most component of the tool 318. The cutters 346A, 346B, 348 as a whole receive rotational output and linear output via the lead screw 336 and the linear block 340, as described with respect to FIG. 3B. Furthermore, each cutter 346A, 346B, 348 can individually translate axially in a forward or reverse direction, to extend or retract in relation to each other, for example, FIG. 3A shows a fully retracted position and FIG. 3B shows a fully extended position of the cutters. In the embodiments, each cutter 346A, 346B, 348 is configured to sequentially move starting with the center cutter 348 to either the extended position 324 or the retracted position 322, as will be discussed with respect to FIG. 4.

When in the extended position 324, the individual machining operations of the outer cutter 346A, the inner cutter 346B, and the center cutter 348 are considered a stage during machining of an object, for example, a workpiece or an obstruction. In the examples, the telescopic machining tool 318 initially extends the center cutter 348 as a first stage to begin machining operations. The inner cutter 346A and the outer cutter 346B extend from the retracted position 322 as a second stage and third stage, respectively, to further the machining operations. In the examples, the inner cutter 346A and the center cutter 348 extend from the outer cutter 348B or can retract and nest inside of the outer cutter 348B by hydraulic, electromechanical, pneumatic, or other types of actuating mechanisms. In this regard, each cutter 346A, 346B, 348 can be independently used to machine a workpiece of a substantial depth, i.e., the distance along the axis of the object.

Figure 3C:
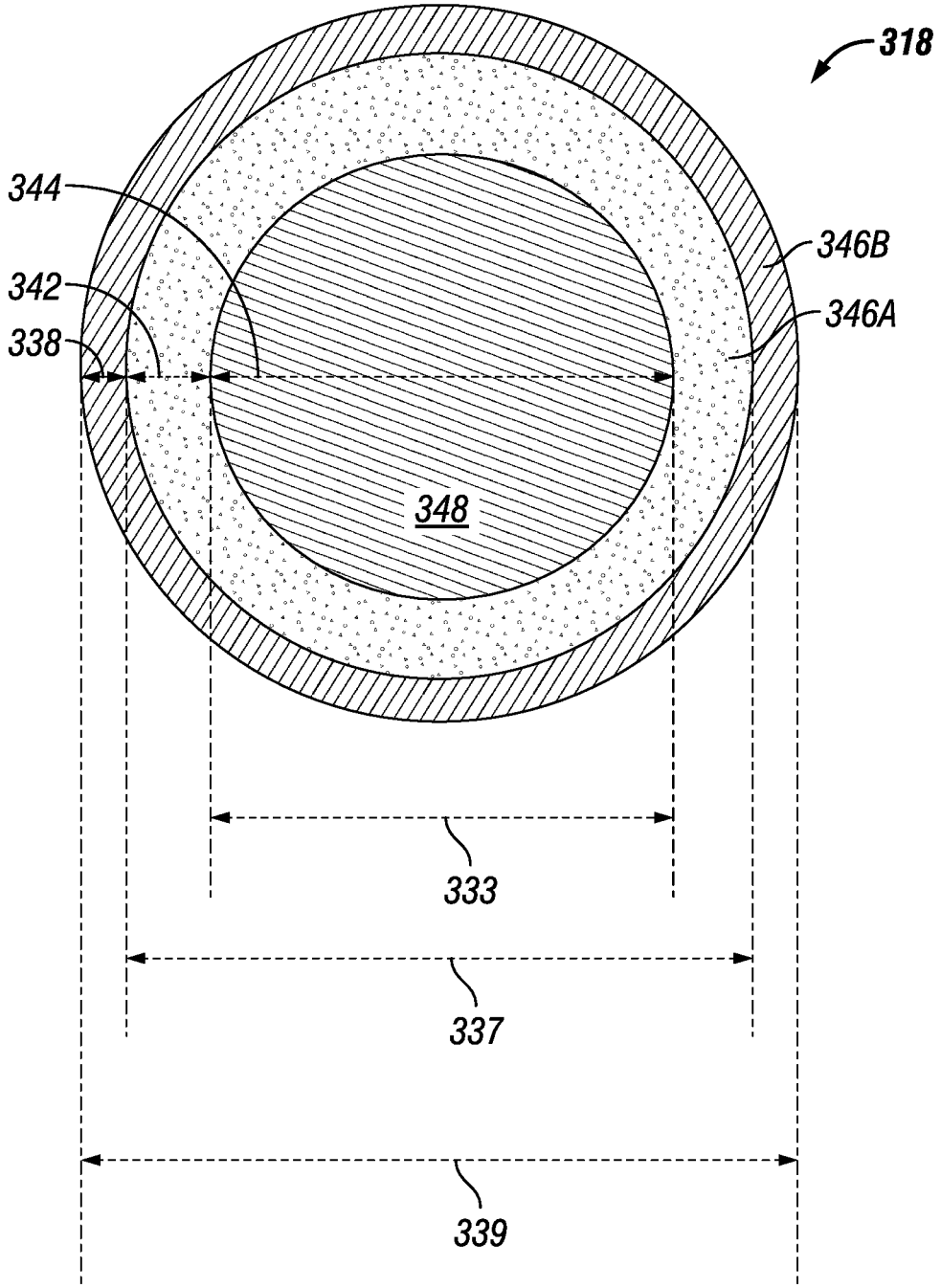
FIG. 3C depicts a cross-sectional view of the example telescopic machining tool of FIG. 3A, according to one or more embodiments.

FIG. 3C is a cross-sectional view of the telescopic machining tool 318 with the center cutter 348 slidably nested within the inner cutter 346A and the inner cutter 346A slidably nested within the outer cutter 346B. As the telescopic machining tool 318 moves from the outer cutter 346B to the center cutter 348, the diameter of the cutters 346A, 346B, 348 becomes progressively smaller. Specifically, the outer cutter 346B has the largest outer diameter 339 and the center cutter 348 has the smallest outer diameter 333 with the inner cutter 346A having an outer diameter 337 between the outer diameter 339 of the outer cutter 348B and the outer diameter 333 of the center cutter 348.

The diameter of each cutter 346A, 346B, 348 is predetermined so as to exert optimum power and/or torque during machining operations. For example, given a specified power and torque requirement to machine an object, the inner and outer diameters of the center cutter 348 can be determined using the following equations:

$$WOB := 0.25 \cdot (D_c - D_i) \cdot f_n \cdot k_{cfz} \cdot \sin(k_r)$$

$$TOB := \frac{D_c^2 - D_i^2}{8000} \langle f_n \cdot k_{cfz} \rangle$$

$$POB := \frac{(D_c^2 - D_i^2) \cdot f_n \cdot k_{cfz} \cdot \pi \cdot n}{240 \cdot 10^6}$$

where:

$D_c$=cutting diameter or the outer diameter of a cutting area $D_i$=the inner diameter of a cutting area $f_n$=feed per revolution $k_{cfz}$=corrected specific cutting force, material dependent $k_r$=tool cutting edge angle $V_c$=cutting speed (meter/minute), where $$V_c = \frac{\pi \cdot Dc \cdot n}{1000}$$

n=spindle speed (RPM)

In the examples, the outer diameters of the inner cutter 346A and the outer cutter 346B can also be determined using the aforementioned equations. Concerning inner diameters, the inner diameter of the inner cutter 346A equals the outer diameter 348B of the center cutter 348. Further, inner diameter of the outer cutter 348B, equals the outer diameter 333 of the inner cutter 348.

The dimensions of the thickness for each cutter 346A, 346B, 348 also differ to provide a balanced output where the same amount of power and torque is required by each cutter 346A, 346B, 348. As shown in FIG. 3C, the larger the diameter of the cutter, the thinner the thickness for that particular cutter. The thickness 338 of the outer cutter 346B is less than the thickness 342 of the inner cutter 346A, and the thickness 342 of the inner cutter 346A is less than the thickness 344 of the center cutter 348, i.e., the radius of the center cutter 333. As described herein, the thickness of an individual cutter includes the distance between two opposing surfaces of that cutter. By varying the diameters and thickness, each individual cutter 346A, 346B, 348 requires the same amount of cutting torque to cut through the object with limited torque on bit (TOB), weight on bit (WOB), and power on bit (POB) requirements.

Figure 4:
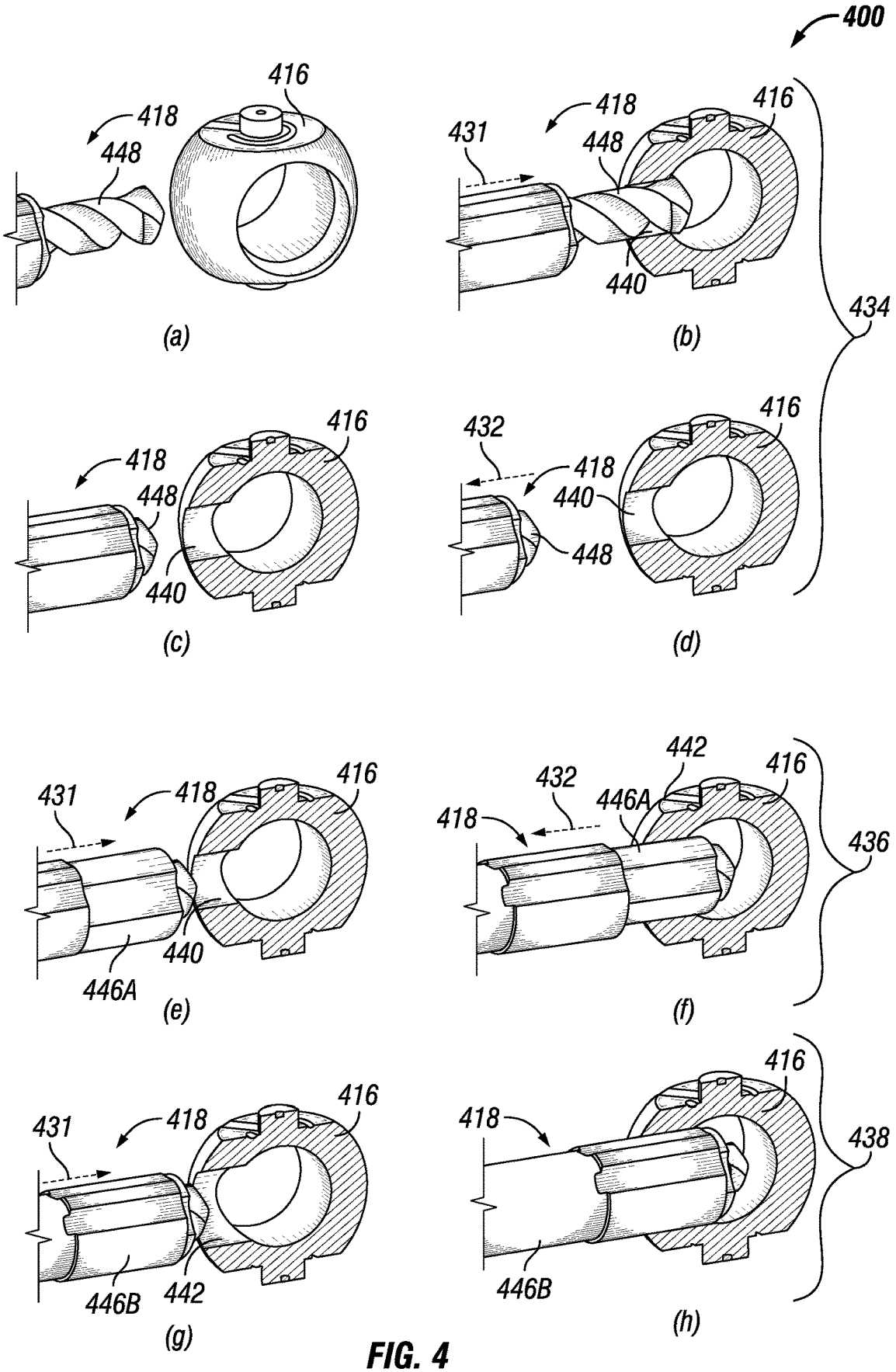
FIG. 4 depicts an example of a sequence of operations for machining a workpiece using a telescopic machining tool, according to one or more embodiments.

FIG. 4 depicts an example of a sequence of operations 400 using a telescopic machining tool 418 to machine a workpiece 416 according to one or more embodiments. The individual machining operations of an outer cutter 446B, an inner cutter 446A, and a center cutter 448 are considered as stages during machining of the workpiece 416 to carry out the steps (a)-(h), as shown. In the examples, the telescopic machining tool 418 initially extends and retracts the center cutter 448 as a first stage 434, including steps (a)-(d) to begin the machining operations. The inner cutter 446A extends from a retracted position as a second stage 436 and includes steps (e)-(f) and the outer cutter 446B extends from the retracted position as a third stage 438 and includes steps (g)-(h). In this order, the center cutter 448 initially machines the workpiece 416 as the stage first 434 of machining operations and completes an entire stroke before moving to the subsequent stages, i.e. second stage 436 and third stage 438. The steps for each stage will continue until the outer cutter 446B, is fully extended to machine the workpiece 416, as shown by step (h).

At step (a), as the telescopic machining tool 418 rotates in a forward direction 431 at a desired RPM, the center cutter 448 extends from the telescoping configuration. As described with respect to FIG. 2, rotational motion is converted into linear motion to axially translate the machining tool 418 in the forward direction 431. At step (b), the center cutter 448 rotates and moves in the forward direction 431 to cut into the workpiece 416 upon contact. With a smaller diameter, the center cutter 448 may provide solid drilling to create a first opening 440, e.g. removal of a circular section of the workpiece 416. The first opening 440 may measure about one (1) inch or other predetermined depth into the workpiece 416.

At step (c), upon reaching the predetermined depth into the workpiece 416, the telescopic machining tool 418 retracts the center cutter 448 into the inner cutter 446A. At step (d), the telescopic machining tool 418 pulls back from the workpiece 416, as shown by arrow 432, after the completion of the first stage 434 and in preparation of subsequent steps. In examples, the telescopic machining tool 418 pulls back by various conveyance mechanisms, such as a lead screw, a tractor, or the like. In some examples, the telescopic machining tool 418 may not pull back from the workpiece 416. At step (e), the telescopic machining tool 418 rotates in a forward direction 431 with the inner cutter 446A extended from the outer cutter 446B. As shown, the center cutter 448 remains nested within the inner cutter 446A during extension. At step (f), the inner cutter 446A contacts and machines into the workpiece 416 about one (1) inch. In particular, the inner cutter 446A can cut and remove a section from the workpiece 416. Thereafter, a core section formed by the removal of the section is removed to increase the diameter of the first opening 440. At step (f), after creating second opening 442 at step (e), forward rotation 431 of the telescopic machining tool 418 stops and is switched to reverse rotation 432. Upon completing the second stage 436, the inner cutter 446A retracts into the outer cutter 446B and the telescopic machining tool 418 pulls back from the workpiece 416 in preparation of subsequent steps.

As shown in step (g), the second opening 442 widens the first opening 440 initially created in the workpiece 416. Further, shown at step (g), the center cutter 448 is slidably nested within the inner cutter 446A that is slidably nested within the outer cutter 446B to provide the telescoping configuration. Thereafter, the outer cutter 446B moves forward in anticipation of contacting and machining the workpiece 416. In some examples, the telescopic machining tool 418 may not pull back from the workpiece 416. At step (h), the outer cutter 446B cuts into the workpiece 416 about one (1) inch to further increase the diameter of the second opening 442 and thus, create a third opening (not shown) with a larger diameter. For example, the outer cutter 446A may cut and remove a section from the workpiece 416 and thereafter, remove a core section formed by the removal of the section to increase the diameter of the first opening 440. The telescopic machining tool 418 can pull back from the workpiece 416 after completing the third stage 438 to end the machining of the workpiece 416 or the telescopic machining tool 418 may proceed with additional steps to continue machining the workpiece 416.

While the machining of the workpiece 416 has been shown and described with respect to certain preferred embodiments, it is obvious that equivalent alterations and modifications will occur to others upon the reading and understanding of the specification. For example, the number of stages to machine the workpiece 416 may be increased or decreased depending on various factors such as material type and hardness, wellbore conditions, and the like. Further, forward and reverse rotation may use different motor speeds based on various factors, such as the type of material to be machined.

Figure 5:
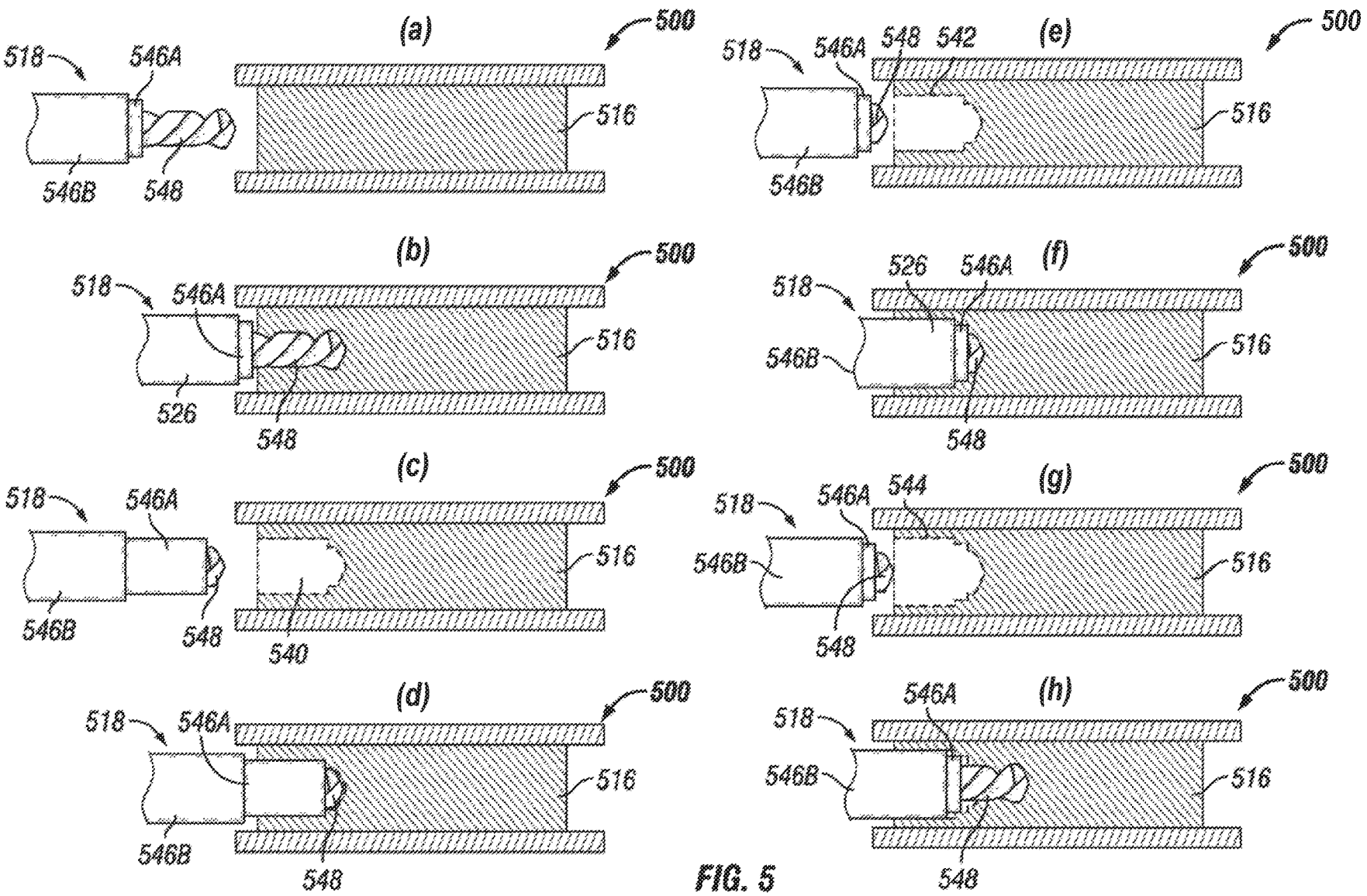
FIG. 5 depicts an example of a sequence of operations for machining an obstruction using a telescopic machining tool, according to one or more embodiments.

FIG. 5 depicts an example of a sequence of operations 500 using a telescopic machining tool 518 to machine an obstruction 516, according to one or more embodiments. In examples, the telescopic machining tool 518 can remove scale, paraffin, sand, or other surfaces, e.g., obstructions 516, formed on a surface of a wellbore or other surfaces located within the wellbore. The telescopic machining tool 518 includes a center cutter 548, an inner cutter 546A, and an outer cutter 546B. When in a retracted position, the center cutter 548 is slidably nested within an inner cutter 546A and the inner cutter 546A is slidably nested within the outer cutter 546B to provide a telescoping configuration. As shown in FIG. 5, steps (a)-(h) are carried out by each of the individual cutters 546B, 546A, 548 to machine the obstruction 516.

At step (a), the telescopic machining tool 518 operates at a desired RPM to generate rotational motion, the center cutter 548 is extended from the inner cutter 546A. As shown, the inner cutter 546A remains nested within the outer cutter 546B. In the embodiments, the telescopic machining tool 518 can receive both rotational motion to drive the tool 518 and the cutters 546B, 546A, 548 and linear motion to translate the tool 518 and cutters 546B, 546A, 548 in a forward or reverse direction. The rotational motion can be maintained while linearly translating the telescopic machining tool 518 to prevent damage to the cutters 546B, 546A, 548.

At step (b), the center cutter 548 begins to machine, e.g., remove a section, of the obstruction 516 upon contact. At step (c), once one (1) inch or other predetermined cutting length is removed from the obstruction 516 to create a first opening 540, the telescopic machining tool 518 may reverse rotation to retract and move the center cutter 548 away from the obstruction 516. The telescopic machining tool 518 can thereafter continue forward rotational motion to extend and rotate the inner cutter 546A.

At step (d), the telescopic machining tool 518 moves forward about one (1) inch, or other length based on the dimensions of the first opening 540, so that the inner cutter 546A contacts and cuts into the obstruction 516. The inner cutter 546A cuts about one (1) inch into the obstruction 516 to increase the diameter of the first opening 540 and thus, create a second opening 542. As previously described, the telescopic machining tool 518 provides linear motion to move the tool 518 in a forward or reverse direction. In some cases, positioning the telescopic machining tool 518 in the first opening 540 requires minimal torque output. In this regard, an actuation device, such as a tractor, may provide a feed rate to axially translate the telescopic machining tool 518 when a higher ROP is desired.

At step (e), forward rotation of the telescopic machining tool 518 stops and is switched to reverse rotation. The inner cutter 546A retracts into the outer cutter 546B and the telescopic machining tool 518 moves away from the obstruction 516 to prepare for subsequent steps. As shown in step (e), the center cutter 548 is slidably nested within the inner cutter 546A and the inner cutter 546A is slidably nested within the outer cutter 546B to provide a retracted telescoping configuration.

At step (f), forward rotation moves the telescopic machining tool 518 in a forward direction where the outer cutter 546B contacts and cuts into the obstruction 516. The outer cutter 548 may cut into the obstruction 516 about one (1) inch to further increase the diameter of the second opening 542 and thus, create a third opening 544. The third opening 544 can include a diameter greater than the second opening 542. At step (g), after creating the third opening 544, forward rotation of the telescopic machining tool 518 stops and is switched to reverse rotation to move the outer cutter 546B away from the obstruction 516 in preparation of subsequent steps.

At step (h), the telescopic machining tool 518 receives rotational motion and linearly motion to rotate and extend the center cutter 548 and repeat the previous steps. Upon contact, the center cutter 548 cuts into the obstruction 516 to machine at a deeper depth into the obstruction 516. The steps can be repeated until an opening is formed through the entire length, e.g. 1 inch (in) (2.54 cm) to about 48 in (4 feet ft), of the obstruction 516 or until the obstruction 516 can be moved or removed by other efforts.

While the machining of obstruction 516 has been shown and described with respect to certain preferred embodiments, it is obvious that equivalent alterations and modifications will occur to others upon the reading and understanding of the specification. For example, the number of stages to machine the workpiece 516 may be increased or decreased depending on various factors such as material type and hardness, wellbore conditions, and the like. Further, forward and reverse rotation may use different motor speeds based on various factors, such as the type of material to be machined.

In addition, to the embodiments described above, many examples of specific combinations are within the scope of the disclosure, some of which are detailed below:

Example 1

A rotary tool for machining a material in a downhole environment, comprising a drive train, a lead screw connected to and rotatable by the drive train, a linear block engaged with but not rotatable by the lead screw so as to convert the rotation of the lead screw into linear motion, a machining tool rotatable by the lead screw and movable linearly by the linear block to machine the material, and wherein the machining tool machines the material in a series of steps.

Example 2

The rotary tool of Example 1, wherein the machining tool is movable linearly by the linear movement of the linear block.

Example 3

The rotary tool of Example 1, wherein the drive train further comprises a motor operable to produce a rotational output, a gearbox engaged with and movable by the motor, a driveshaft rotatable by the gearbox to rotate the lead screw.

Example 4

The rotary tool of Example 1, wherein the machining tool comprises: an outer cutter, an inner cutter nested within the outer cutter, a center cutter nested within the inner cutter, and wherein the inner cutter and the center cutter are slidable telescopically to extend out past and retract within the outer cutter.

Example 5

The rotary tool of Example 1, further comprising an actuation device connected to the rotary tool and positionable in the downhole environment to anchor the rotary tool at a location in the downhole environment.

Example 6

The rotary tool of Example 1, wherein the machining tool is replaceable based on the type of machining operations implemented in the downhole environment.

Example 7

The rotary tool of Example 1, wherein the machining tool comprising a stabilizer to suppress vibrations.

Example 8

The rotary tool of Example 1, further comprising a turbine in fluid communication with fluid in the downhole environment and operable to circulate material cuttings generated by the machining tool and circulate the fluid to cool the machining tool, and a cleaning device operable to remove the material cuttings generated by the machining tool.

Example 9

A method of machining a material, the method comprising extending a center cutter nested within an inner cutter to machine the material, retracting the center cutter to move away from the material and nest inside the inner cutter, extending the inner cutter nested within an outer cutter to machine the material, retracting the inner cutter to move away from the material and nest inside the outer cutter, extending the outer cutter to machine the material, and wherein the center cutter, the inner cutter, and the outer cutter individually machine the material in a series of steps.

Example 10

The method of Example 9 wherein the center, inner, and outer cutters machine the material by being rotated by a rotary tool, and extending and retracting the center, inner, and outer cutters comprises translating rotation motion of the rotary tool into linear motion.

Example 11

The method of Example 9, further comprising extending each of the center, inner, and outer cutters to a predetermined cutting length for each and retracting each of the center, inner, and outer cutters when the respective predetermined cutting lengths for each is reached.

Example 12

The method of Example 9, further comprising removing an annular area from the material using the outer and inner cutters and removing a solid area from the material using the center cutter.

Example 13

The method of Example 9, further comprising replacing the machining tool based on the type of machining operations implemented in a downhole environment.

Example 14

A telescopic machining tool, comprising an outer cutter, an inner cutter nested within the outer cutter, a center cutter nested within the inner cutter, wherein the inner cutter and the center cutter are slidable telescopically to extend out past and retract within the outer cutter, and wherein the outer cutter, the inner cutter, and the center cutter individually machine a material in a series of steps.

Example 15

The telescopic machining tool of Example 14, wherein the outer and inner cutters are hollow so as to remove an annular area from the material and the center cutter is not hollow so as to remove a solid area from the material.

Example 16

The telescopic machining tool of Example 14, wherein the thickness of the material ranges from about 1 inch (in) (2.54 centimeters (cm)) to about 48 in (4 feet (ft)).

Example 17

The telescopic machining tool of Example 14, wherein each of the center cutter, the inner cutter, and the outer cutter are extendable to machine up to about 3.0 inches (in) of the material in a single machining operation.

Example 18

The telescopic machining tool of Example 14, wherein a diameter for each of the center cutter, the inner cutter, and the outer cutter differs to maintain a proportional feed speed to feed rate ratio of the telescopic machining tool.

Example 19

The telescopic machining tool of Example 14, wherein a thickness for each of the center cutter, the inner cutter, and the outer cutter differs to maintain a constant machining torque.

Example 20

The telescopic machining tool of Example 14, wherein the telescopic machining tool is replaceable based on the type of machining operations implemented in a downhole environment Example 21

The telescopic machining tool of Example 14, wherein the telescopic machining tool comprising a stabilizer to suppress vibrations.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . " Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A rotary tool for machining a material in a downhole environment, comprising:

a rotary drive train that produces rotational output;

a lead screw connected to and rotatable by the drive train;

a linear block engaged with the lead screw but restricted from rotation to convert the rotation of the lead screw into linear motion of the linear block; and a machining tool rotatable by the lead screw and movable linearly by the linear movement of the linear block to machine the material;

wherein the machining tool machines the material in a series of steps.

2. The rotary tool of claim 1, wherein the drive train further comprises:

a motor operable to produce a rotational output;

a gearbox engaged with and movable by the motor; and a driveshaft rotatable by the gearbox to rotate the lead screw.

3. The rotary tool of claim 1, wherein the machining tool comprises:

an outer cutter;

an inner cutter nested within the outer cutter; and a center cutter nested within the inner cutter;

wherein the inner cutter and the center cutter are slidable telescopically to extend out past and retract within the outer cutter.

4. The rotary tool of claim 1, further comprising an actuation device connected to the rotary tool and positionable in the downhole environment to anchor the rotary tool at a location in the downhole environment.

5. The rotary tool of claim 1, wherein the machining tool is replaceable based on a type of machining operation implemented in the downhole environment.

6. The rotary tool of claim 1, wherein the machining tool comprises a stabilizer to suppress vibrations.

7. The rotary tool of claim 1, further comprising a turbine in fluid communication with fluid in the downhole environment and operable to circulate material cuttings generated by the machining tool and circulate the fluid to cool the machining tool.

8. A method of machining a material, the method comprising:

extending a center cutter nested within an inner cutter to machine the material;

retracting the center cutter to move away from the material and nest inside the inner cutter;

extending the inner cutter nested within an outer cutter to machine the material;

retracting the inner cutter to move away from the material and nest inside the outer cutter; and extending the outer cutter to machine the material;

wherein the center cutter, the inner cutter, and the outer cutter individually machine the material in a series of steps.

9. The method of claim 8 wherein:

the center, inner, and outer cutters machine the material by being rotated by a rotary tool; and extending and retracting the center, inner, and outer cutters comprises translating rotation motion of the rotary tool into linear motion.

10. The method of claim 8, further comprising extending each of the center, inner, and outer cutters to a predetermined cutting length for each and retracting each of the center, inner, and outer cutters when the respective predetermined cutting lengths for each is reached.

11. The method of claim 8, further comprising removing an annular area from the material using the outer and inner cutters and removing a solid area from the material using the center cutter.

12. The method of claim 8, further comprising replacing the machining tool based on a type of machining operation implemented in a downhole environment.

13. A telescopic machining tool for machining a material, comprising:

an outer cutter;

an inner cutter nested within the outer cutter; and a center cutter nested within the inner cutter;

wherein the center cutter is independently slidable telescopically to extend out past the outer cutter to machine the material and retract within the inner cutter;

wherein the inner cutter is independently slidable telescopically to extend out past the outer cutter to machine the material and retract within the outer cutter with the center cutter retracted after being extended;

wherein the outer cutter is extendable to machine the material with the center and inner cutters retracted after being extended; and wherein the outer cutter, the inner cutter, and the center cutter are operable to individually machine the material in a series of steps.

14. The telescopic machining tool of claim 13, wherein the outer and inner cutters are hollow so as to remove an annular area from the material and the center cutter is not hollow so as to remove a solid area from the material.

15. The telescopic machining tool of claim 13, wherein a thickness of the material ranges from about 1 inch (in)(2.54 centimeters (cm)) to about 48 in (4 feet (ft)).

16. The telescopic machining tool of claim 13, wherein each of the center cutter, the inner cutter, and the outer cutter are extendable to machine up to about 3.0 inches (in) of the material in a single machining operation.

17. The telescopic machining tool of claim 13, wherein a diameter for each of the center cutter, the inner cutter, and the outer cutter differs to maintain a proportional feed speed to feed rate ratio of the telescopic machining tool.

18. The telescopic machining tool of claim 13, wherein a thickness for each of the center cutter, the inner cutter, and the outer cutter differs to maintain a constant machining torque.

19. The telescopic machining tool of claim 13, wherein the telescopic machining tool is replaceable based on a type of machining operation implemented in a downhole environment.

20. The telescopic machining tool of claim 13, wherein the telescopic machining tool comprising a stabilizer to suppress vibrations.

* * * * *